US005465107A

United States Patent [19]

Mayo et al.

[11] Patent Number: 5,465,107

[45] Date of Patent: Nov. 7, 1995

[54] PRINTHEAD DRIVE SYSTEM FOR SERIAL PRINTER

[75] Inventors: Randall D. Mayo, Georgetown; Donald N. Spitz, Lexington, both of Ky.

[73] Assignee: Lexmark International, Inc., Greenwich, Conn.

[21] Appl. No.: 123,408

[22] Filed: Sep. 17, 1993

[51] Int. Cl.[6] ..... B41J 2/01; B41J 19/14

[52] U.S. Cl. ..... 346/139 R; 346/139 B; 347/37; 400/323; 400/335

[58] Field of Search ..... 346/139 A, 139 B, 346/139 D, 139 R; 347/37, 39; 400/323, 335, 320, 322; 74/37, 89.2, 89.22

[56] References Cited

U.S. PATENT DOCUMENTS

| | | | |
|---|---|---|---|
| 4,084,681 | 4/1978 | Heinzl et al. | 197/82 |
| 4,525,726 | 6/1985 | Mori | 347/37 |
| 4,668,963 | 5/1987 | Tanabe et al. | 346/139 B X |
| 4,869,609 | 9/1989 | Iwata | 400/323 |
| 5,098,209 | 3/1992 | Gomoll et al. | 400/335 X |

*Primary Examiner*—Benjamin R. Fuller

*Assistant Examiner*—Alrick Bobb

*Attorney, Agent, or Firm*—B. Franklin Griffin, Jr.

[57] ABSTRACT

The printhead of an ink jet printer is mounted on a printhead carrier for reciprocal movement on a carrier guide rod above a record feed path. A bi-directional motor drives a drive belt attached to the carrier to thereby pull the printhead back and forth. The belt is attached to the carrier at two points which are spaced from the axis of the carrier guide rod, one point being above the axis and the other point being below the axis. The arrangement is such that any tilt of the printhead carrier in a vertical plane, resulting from a pulling force of the drive belt, is always in the same direction regardless of the direction in which the printhead carrier is pulled. This improves the accuracy of ink dot placement thereby giving better print quality. The drive belt is mounted on pulleys which are positioned such that there is an upward incline from each attachment point to a pulley. The carrier is provided with feet which ride in a groove in a carrier guide. When the belt is driven, an upward component of force is applied to the carrier at the point where the belt is attached to the carrier. This upward force tends to rotate the printhead carrier about the guide rod, thereby forcing the carrier feet into engagement with the groove in the carrier guide. This reduces the tendency of the carrier to rotate in a horizontal plane as a pulling force is applied to it.

17 Claims, 2 Drawing Sheets

PRINTHEAD DRIVE SYSTEM FOR SERIAL PRINTER

FIELD OF THE INVENTION

This invention relates to a printhead drive system for a serial printer and more particularly to a printhead drive system of the type wherein a printhead having ink jet nozzles in a face thereof is moved back and forth across the path of a record sheet during printing.

BACKGROUND OF THE INVENTION

Ink jet printers of the prior art include a printhead having ink ejecting nozzles therein, the printhead being pulled back and forth across a record path as ink is intermittently ejected from the nozzles to place small dots of ink on a record sheet. The dots overlap so as to create characters or graphic images. Recent developments have enabled printing with dot densities of up to 600 dots per inch. Obviously, accuracy of dot placement is of utmost importance if characters and lines are to be printed without ragged or uneven edges.

It has been conventional to mount an ink jet printhead on a carrier which is slidable on a guide rod extending transverse to the record feed path. A belt, driven by a bi-directional motor, is attached to the carrier such that the printhead carrier is pulled in a first or a second direction on the guide rod depending on the direction of rotation of the motor. In the prior art it has been the practice to attach the belt to the carrier at a single point or at aligned points on opposite sides of the carrier. That is, a straight line drawn between the points of attachment of the belt is parallel to the axis of the guide rod. This arrangement leads to variations in dot placement depending upon the direction in which the printhead carrier is being pulled at the time ink is ejected from a nozzle. This variation in dot placement results from the fact that a small clearance must be provided between the printhead carrier and the guide rod upon which it slides in order to permit free sliding movement. Because of wear, this clearance increases with printer use. The clearance enables the carrier to "tilt" on the guide rod in either a first or a second direction depending upon the direction in which the carrier is being pulled by the belt. The tilting moves the ink jet nozzles in an arc so that ink is no longer ejected from the nozzles in a direction normal to the record. Ink dots are thus displaced from the ideal print position by a distance $d_1$ or $d_2$, these distances extending in opposite directions from the ideal print position.

SUMMARY OF THE INVENTION

An object of the present invention is to provide a drive system for the printhead of a serial printer, the drive system providing improved accuracy in the placement of markings on a record.

A further object of the present invention is to provide a drive system for the printhead of an ink jet printer, the drive system providing improved accuracy of ink dot placement on a record.

Another object of the invention is to provide a drive system for an ink jet printer, the drive system tending to tilt the printhead in the same direction regardless of the direction in which it is being moved.

In accordance with the invention, a printhead carrier having a printhead thereon is mounted on a guide rod and attached to a drive belt at two attachment points which are located on opposite sides of a first plane in which the axis of the guide rod, and preferably, the nominal center of mass of the carrier, is/are located. The two attachment points lie in second and third planes, respectively, which are parallel to, and located on opposite sides of the first plane. A bi-directional motor drives the belt to pull the printhead carrier back and forth across the path of a record sheet. Because of the location of the attachment points the pulling force of the belt tends to tilt the printhead carrier in the same direction in a second plane, normal to the first plane, regardless of the direction in which the carrier is pulled.

A feature of the invention is the provision of feet on the printhead carrier and a carrier guide having a groove in which the feet slide. The drive belt is looped around pulleys such that the belt inclines upwardly toward a pulley from each attachment point. When the belt pulls on the carrier, a vertical force component tends to rotate the carrier about the guide rod thereby forcing the feet into the groove. This reduces the tendency of the carrier to rotate about a vertical axis as a pulling force is applied at one of the attachment points.

Other objects and advantages of the invention and its mode of operation will become apparent upon consideration of the following description and the accompanying drawings.

DESCRIPTION OF PREFERRED EMBODIMENT

The invention will be described in the context of a printer wherein a printhead is reciprocally driven above a horizontal record feed path by a drive belt lying generally in a vertical plane. In other printer arrangements a printhead may be driven parallel to a vertical portion of a record feed path, and/or the belt may be disposed in a generally horizontal plane. Therefore, the terms "above", "below", "horizontal" and "vertical" are used hereafter as words of description rather than words of limitation.

Figure 3:
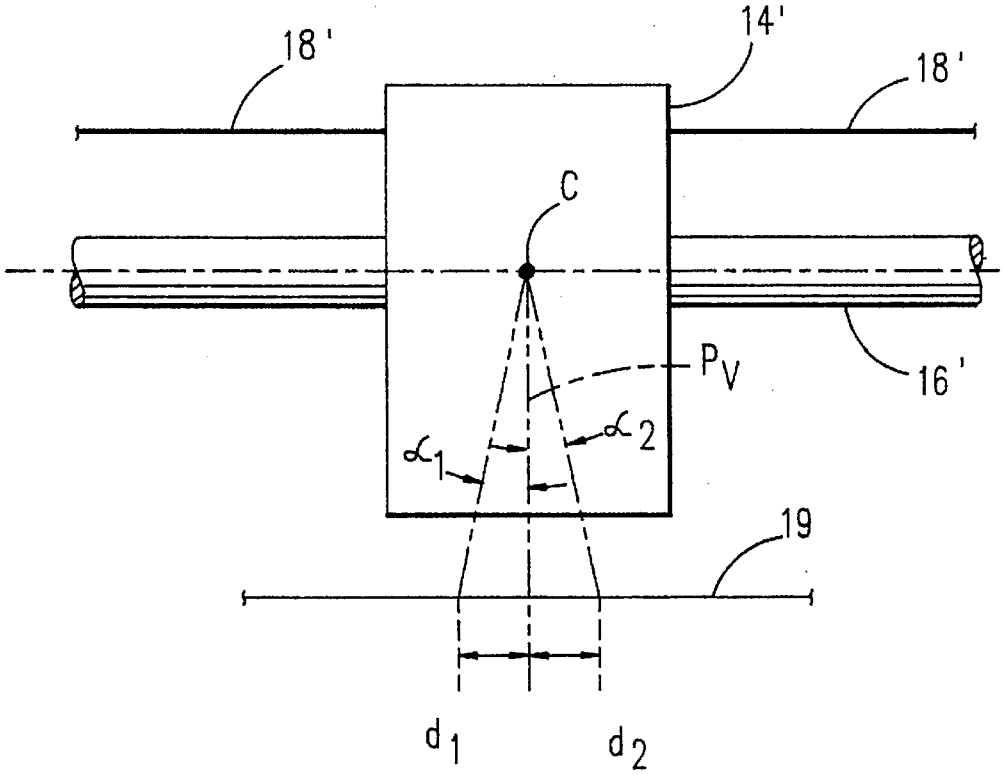
FIG. 3 PRIOR ART

FIG. 3 is a diagram illustrating the problem resulting from printhead tilt in a prior art ink jet printer. A printhead carrier 14' is mounted for sliding movement on a guide rod 16' and is pulled back and forth over a record 19 in a direction transverse to the direction of record feed.

Ideally, ink jet nozzles (not visible) on the bottom of the printhead should eject droplets of ink in vertical planes $P_v$ normal to the upper surface of the record. However, a small but finite bearing clearance must be provided to permit the carrier 14' to slide on guide rod 16'. This clearance permits the carrier to tilt in a plane which extends normal to the record feed path and through the axis of the guide rod, the center C of rotation being on the guide rod axis. When belt 18' pulls to the right, the printhead carrier rotates through an angle $\alpha_1$, so that ink dots placed on the record are displaced from the ideal placement by the distance $d_2$. On the other hand, when belt 18' pulls to the left, the printhead carrier rotates through the angle $\alpha_2$ so that the ink dots placed on the record are displaced from the ideal placement by the distance $d_2$. Thus, there can be a total placement variation of $d_1+d_2$ between dots printed while the carrier is moving in one direction and those printed while the carrier is moving in the other direction. Furthermore, it should be apparent that as the carrier bearings wear, the displacements $d_1$ and $d_2$ will increase with an attendant degradation of print quality.

Figure 1:
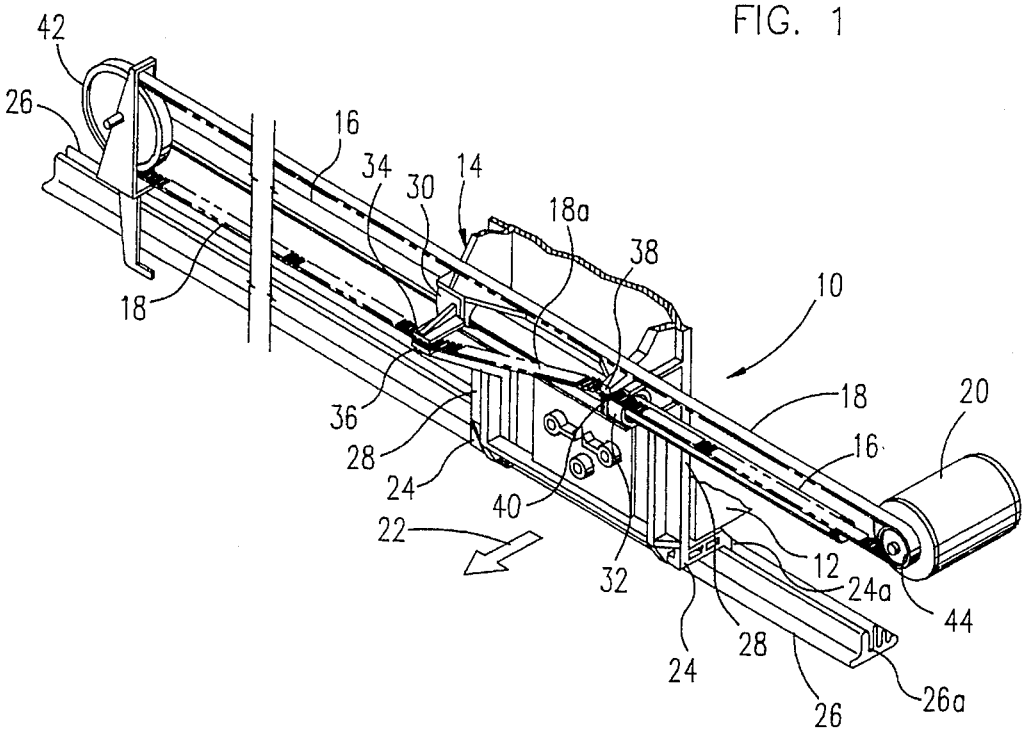
FIG. 1 is a perspective view of a printhead drive system looking generally from the exit side of the print station.

Referring now to FIG. 1, a printhead drive system comprises a printhead assembly 10 including a printhead 12 and a printhead carrier 14; a carrier guide rod 16, a toothed drive belt 18 and a bi-directional drive motor 20. The printhead 12 may be an ink jet or other printhead of conventional design and may take many forms hence only a portion thereof is shown. Also, FIG. 1 shows only that portion of printhead carrier 14 necessary for an understanding of the present invention. Record sheets are fed in the direction indicated by arrow 22, this direction being defined as the downstream direction.

The printhead carrier 14 serves as a support means for the printhead and has two members 24 extending horizontally in the upstream direction. A foot 24*a* extends downwardly from each member 24 and rides in a groove 26*a* in a carrier guide member 26 that extends transverse to the record feed path. The printhead carrier includes members 28 which are integral with and extend vertically from members 24. Two bearing housings 30, 32 are integral with and extend outwardly from members 28 in the downstream direction. A slide bearing (not shown) is provided in each bearing housing so that the printhead carrier may slide on the carrier guide rod 16.

The printhead carrier 14 is provided with a first attachment means comprising gripper jaws 34, 36 and a second attachment means comprising gripper jaws 38, 40 for attaching the printhead carrier to the drive belt 18. The lower gripper jaws 36, 40 have flat surfaces for engaging belt 16 while the upper gripper jaws have one or more projections for engaging teeth on the drive belt.

The drive belt 18 may be a closed loop belt which extends over an idler pulley 42 and a driven pulley 44, the driven pulley being driven by the bi-directional drive motor 20.

A record sheet is fed into the printing station 10 along a path which extends under the carrier guide member 26. The printhead 12 includes an ink supply and has ink jet nozzles (not shown) in its lower surface for ejecting ink toward the record path at a point slightly downstream from carrier guide member 26. To accomplish printing, the drive motor 20 drives the belt 18 first in one direction and then the other transverse to the direction of record movement. Since the printhead carrier is secured to the belt by the attachment means 34, 36 and 38, 40, the carrier and the printhead 12 mounted thereon are pulled first in one direction and then the other, the carrier sliding on the guide rod 16. The foot 24*a* rides in a groove 26*a* in guide member 26 and prevents the weight of the printhead and carrier from pivoting the carrier about the guide rod.

In accordance with the present invention the guide rod 16 is disposed such that its axis lies in a plane A (FIG. 2) generally parallel to the direction of record feed and the attachment means 34, 36 and 38, 40 grip belt 18 at points in planes P1 and P2 (FIG. 2) which are parallel to and on opposite sides of plane A. Preferably, guide rod 16 is disposed such that its axis and the center of mass of the assembly 10 (point B) are located in the same plane. In addition, the pulleys 42 and 44 are sized and positioned such that the belt segments 18*a* extending from attachment means 34, 36 and 38, 40 to the pulleys 42 and 44, respectively, are not parallel to the axis A of the guide rod 16 but instead extend upwardly at small angles Θ from the attachment points to the respective pulleys. The angles Θ are exaggerated in FIG. 2 for purposes of illustration and may, in actual practice, be on the order of 0.25° to 2.5°. The angles need not be equal.

Figure 2:
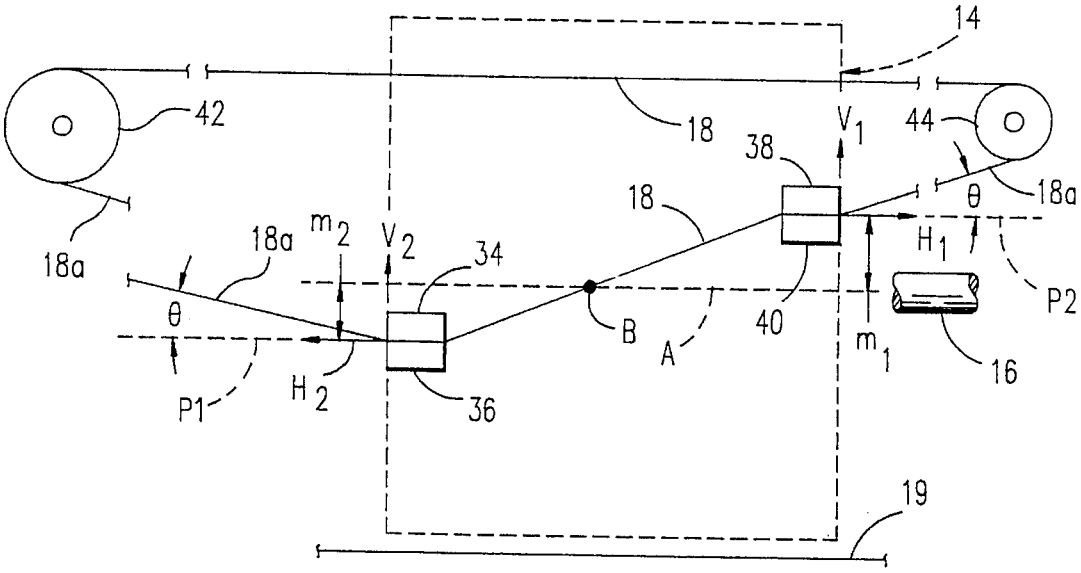
FIG. 2 is a diagram useful in explaining forces acting on the printhead carrier; and, FIG. 3 is a diagram illustrating misplacement of ink dots in a prior art printer.

In FIG. 2, the point B indicates the vertical location of the nominal center of mass of the assembly 10. For a printhead reservoir using foam to hold the ink supply, as ink in the printhead 12 is depleted, the actual center of mass of the assembly 10 moves upwardly. That is, with a full ink supply the center of mass of the assembly 10 is at a first limit position below point B but when the ink supply is fully exhausted the center of mass of the assembly is at a second limit position above point B. Typically, the distance between the limit positions is quite small, being on the order of about 3 mm. Point B, the nominal center of mass, is located at the midpoint between the first and second limit positions and it is preferred, but not essential, that the axis of guide rod 16 and the nominal center of mass be located in the same plane A. The plane P2 in which the attachment means 38, 40 grip belt 18 is spaced further from plane A than the second limit position and the plane P1 in which attachment means 34, 36 grip the belt is spaced further from plane A than the first limit position. This same principle may be applied to a printhead reservoir which does not utilize foam as an ink carrier, but the details of movement of the center of mass of the assembly from a full to empty ink supply would differ, the difference being mainly in the direction and range through which tile center of mass travels. For example, if the ink were held in a collapsing bladder in the printhead assembly, the center of mass would move downwardly as ink was used up.

When pulley 44 is driven in a counter-clockwise direction as viewed in FIG. 2, a pulling force is applied through belt segment 18*a* to the printhead carrier 14 at the point of attachment of gripper jaws 38, 40. The pulling force has a horizontal component $H_1$ in the plane P2 and a vertical component $V_1$ normal to the plane P2. The horizontal component of force moves the printhead carrier to the right, this movement being slightly resisted by sliding friction between the feet 24*a* (FIG. 1) and the carrier guide 26, and between the slide bearings and guide rod 16.

The horizontal force component $H_1$ has a moment arm $m_1$ which is the vertical distance between the plane P2 in which the point of belt gripping is located and the actual center of mass of the assembly 10. The torque resulting from force component $H_1$ tends to rotate or tilt the print carrier 14 clockwise in a vertical plane about the actual center of mass. In FIG. 2, this axis will extend through point B normal to the axis of guide rod 16 if one-half of the supply of ink has been used so that the actual center of mass coincides with the nominal center of mass.

The advantage of the present invention over the prior art is that regardless of the direction in which the printhead carrier is pulled, it is always tilted in the same direction so that the dots are displaced by the distance $d_1$. In FIG. 2, if the pulley 44 is driven in a clockwise direction a pulling force is exerted on printhead carrier 14 at the point where attachment means 34, 36 grips belt 18. The pulling force has a horizontal component $H_2$ and a vertical component $V_2$. The horizontal component $H_2$ has a moment arm $m_2$ equal to the vertical distance between the actual center of mass and the plane P1 in which the belt is gripped. Thus, the horizontal component of force H2 exerted at the attachment means 34, 36 tends to rotate the printhead carrier in a vertical plane in the clockwise direction about its actual center of mass.

It will be noted from the foregoing description that the horizontal force $H_1$ which moves the printhead carrier 14 to the right, and the horizontal force $H_2$ which moves the printhead carrier to the left, both tend to tilt the printhead carrier in a clockwise direction in a vertical plane extending normal to the record feed path through the axis of guide rod 16. From FIG. 3 it should be obvious that the printhead carrier is tilted through angle $\alpha_1$ regardless of the direction in which it is pulled so that all printed dots are displaced from the vertical plane $P_v$ by the distance $d_1$. There is thus no variation in dot placement when printing takes place from left to right or right to left.

Because of the upward slope of belt segments 18*a* from the attachment means 34, 36 and 38, 40, the vertical components of force $v_1$ and $v_2$ are both in the upward direction. From FIG. 1 it is obvious that these forces have moment arms equal to the distance between the axis of guide rod 16 and the points at which belt 18 is gripped by the attachment means. The resulting torque tends to rotate the printhead carrier about the guide rod in a direction which urges feet 24*a* of the printhead carrier into the groove 26*a* in carrier guide 26. Since carrier guide 26 is parallel to guide rod 16, feet 24*a* tend to keep the printhead carrier from rotating in a horizontal plane in response to the pulling force $H_1$ or $H_2$.

While a preferred embodiment of the invention has been described in specific detail, it will be understood that various substitutions and modifications may be made in the described embodiment without departing from the spirit and scope of the invention, as defined by the appended claims. For example, the principles of the invention are equally applicable to other serial printers such as wire matrix or thermal printers. Where the printhead 12 does not carry an ink or printing medium which is used up during printing, the actual center of mass of the assembly 10 will not move. In this case the plane in which the axis of the guide rod is located preferably will be coincident with the plane in which the actual center of mass lies. Furthermore, it is obvious that the drive belt 18 need not be either a closed loop or a toothed belt. Fastening means other than gripper jaws may be used to attach the belt to the printhead carrier. The printhead carrier may be disposed so that ink is ejected from the printhead in any direction compatible with the chosen path of record feed. Other modifications will be obvious to those skilled in the art.

The invention in which an exclusive property or privilege is claimed is defined as follows:

1. A printhead drive system for a printer having a printhead assembly pulled back and forth transverse to a direction of feed of a record sheet on which printing is to take place, said drive system comprising:

a guide rod having an axis lying in a first plane, said first plane generally parallel to the direction of feed of the record sheet and said guide rod extending transverse to the direction of feed of the record sheet;

support means for slidably supporting said printhead assembly on said guide rod;

pulling means for applying first and second pulling forces to said support means to pull said printhead assembly in first and second directions along said guide rod, said pulling means being attached to said support means at first and second positions located on opposite sides of said first plane, whereby said first and second pulling forces tend to tilt said printhead assembly in a same direction in a second plane normal to said first plane which is generally parallel to the direction of feed of the record sheet.

2. A printhead drive system as claimed in claim 1 wherein said printhead assembly has a center of mass, said guide rod being disposed such that the axis of said guide rod and said center of mass are both in said first plane.

3. A printhead drive system as claimed in claim 1 wherein said printhead assembly carries printing ink such that said printhead assembly has a center of mass that moves from a first to a second limit point as the ink is depleted, said first plane being equidistant from said first and said second limit point.

4. A printhead drive system as claimed in claim 3 wherein said first and second positions are located in second and third planes, respectively, said second and third planes being spaced further from said first plane than said first and said second limit point, respectively.

5. A printhead drive system as claimed in claim 1 and further comprising a guide means for guiding said printhead assembly, said guide means having a groove therein, said support means including a foot slidable in said groove, said pulling means exerting a force on said support means tending to rotate said support means about the axis of said guide rod in a direction such that said foot is urged into said groove as said support means is pulled in said first and second directions.

6. A printhead drive system as claimed in claim 1 wherein said support means includes first and second attachment means disposed at said first and second positions for attaching said pulling means to said support means, said pulling means comprising a drive motor for driving a first pulley, an idler pulley, and a belt extending around said first pulley and said idler pulley and attached to said support means by said attachment means.

7. A printhead drive system as claimed in claim 5 wherein said support means includes first and second attachment means disposed at said first and second positions for attaching said pulling means to said support means, said pulling means comprising a drive motor for driving a first pulley, an idler pulley, and a belt extending around said first pulley and idler pulleys and attached to said support means by said attachment means, said belt having segments extending from said attachment means to said first pulley and idler pulley disposed at angles with respect to the axis of said guide rod.

8. A printhead drive system for moving a printhead back and forth transverse to a direction of feed of a record sheet on which printing is to take place, said drive system comprising:

a guide rod having an axis extending transverse to the direction of feed of the record sheet;

a drive belt;

means for moving said drive belt in a first or a second direction;

a printhead assembly including a printhead carrier supporting a printhead having a supply of ink therein, said printhead carrier including bearing means for slidably supporting the printhead carrier on said guide rod, and, first and second attachment means for attaching the printhead carrier to said drive belt whereby a first pulley force or a second pulling force is exerted on said printhead carrier by said drive belt as said drive belt is moved in said first or said second direction, said printhead assembly having a nominal center of mass, the axis of said guide rod and said nominal center of mass being located in a first plane that is parallel to the direction of record feed, said first and second attachment means being positioned relative to said guide rod and said center of mass such that said first force tends to rotate said printhead carrier in a first direction in a second plane perpendicular to said first plane and said second pulling force tends to rotate said printhead carrier in said first direction in said second plane.

9. A printhead drive system as claimed in claim 8 and further comprising a guide member extending transverse to the direction of record feed, said printhead carrier having a projection thereon for engaging said guide member to prevent rotation of said printhead carrier about the axis of said guide rod.

10. A printhead drive system as claimed in claim 8 wherein said printhead assembly has a center of mass which moves relative to said first plane between a first limit position on one side of said first plane and a second limit position on a second side of said first of said first and second plane as the ink supply is depleted, said first attachment means being attached to said belt at a point first further from said first plane than said first limit position and said second of said first and second attachment means being attached to said belt at a second point which is further from said first point plane than said second limit position, said first and second point being on opposite sides of said first plane.

11. A printhead drive system for an ink jet printer wherein a printhead is pulled back and forth transverse to a direction of record feed, said drive system comprising:

a printhead assembly comprising a printhead carrier having an ink jet printhead thereon, said printhead assembly having a nominal center of mass;

an elongated guide rod having an axis extending transverse to the direction of feed of the record for slidably supporting said printhead assembly, the axis of said guide rod being located in a first plane which is generally parallel to the direction of record feed, said plane extending through said nominal center of mass;

a drive means for driving said printhead assembly back and forth on said elongated guide rod; and, means for attaching said drive means to said printhead carrier at first and second points, said first and second points being located in second and third planes, respectively, said second and third planes being on opposite sides of said first plane.

12. A printhead drive system as claimed in claim 11 wherein said drive means comprises a belt attached to said printhead carrier and a bi-directional drive motor for driving said belt.

13. A printhead drive system as claimed in claim 12 and further comprising a drive pulley driven by said drive motor and an idler pulley, said belt being looped over said drive pulley and said idler pulley, said belt extending from said first and second points to said drive pulley and said idler pulleys, respectively, along paths that form angles with respect to the axis of said guide rod.

14. A printhead drive system as claimed in claim 11 and further comprising means for preventing rotation of said printhead assembly about said elongated guide rod.

15. A printhead drive system as claimed in claim 11 wherein said means for attaching said drive means comprises first and second sets of gripper jaws for gripping said drive means.

16. A printhead drive system as claimed in claim 15 wherein teeth are provided on said drive belt and at least one gripper jaw of each of said sets has at least one projection for engaging said teeth.

17. A printhead drive system as claimed in claim 14 wherein said means for preventing rotation of said printhead assembly comprises a guide member having a groove therein extending transverse to the direction of record feed, said printhead carrier having a projection thereon which engages said guide member and slides in said groove.

* * * * *